US005411073A

United States Patent [19]

Andrews

[11] Patent Number: 5,411,073

[45] Date of Patent: May 2, 1995

[54] HINGED FRAME SYSTEM

[75] Inventor: Rupert I. Andrews, Hampshire, United Kingdom

[73] Assignee: Frames Design & Build Limited, London, England

[21] Appl. No.: 94,066

[22] PCT Filed: Jan. 27, 1992

[86] PCT No.: PCT/GB92/00148

§ 371 Date: Nov. 2, 1993

§ 102(e) Date: Nov. 2, 1993

[87] PCT Pub. No.: WO92/13157

PCT Pub. Date: Aug. 6, 1992

[30] Foreign Application Priority Data

Jan. 28, 1991 [GB] United Kingdom ..... 9101821

[51] Int. Cl.[6] ..... A47G 5/00

[52] U.S. Cl. ..... 160/135; 160/229.1

[58] Field of Search ..... 160/135, 229.1, 233, 160/234, 218; 52/238.1, 239; 40/605, 606, 610

[56] References Cited

U.S. PATENT DOCUMENTS

| | | | |
|---|---|---|---|
| 3,809,142 | 5/1974 | Bleeker | 160/135 |
| 4,129,163 | 12/1978 | Johnson | 160/135 |
| 4,774,792 | 10/1988 | Ballance | 160/135 X |
| 4,956,953 | 9/1990 | Bates | 160/135 X |
| 5,242,241 | 9/1993 | Nelson | 160/135 X |

FOREIGN PATENT DOCUMENTS

| | | |
|---|---|---|
| 0053933 | 6/1982 | European Pat. Off. . |
| 2611966 | 9/1988 | France . |
| 3600933 | 7/1987 | Germany . |
| 632034 | 9/1982 | Switzerland . |

*Primary Examiner*—David M. Purol

*Attorney, Agent, or Firm*—Ostrolenk, Faber, Gerb & Soffen

[57] ABSTRACT

A hinged frame system for use as a room divider, in exhibition display systems or in furniture includes at least two panels which are hingedly connected together. One of the panels has a concave edge profile of a partially circular cross-section and the adjacent panel has a matching convex edge profile and the two panels are clamped together by a clamp.

20 Claims, 1 Drawing Sheet

HINGED FRAME SYSTEM

BACKGROUND OF THE INVENTION

1. Field of the Invention

The present invention relates to hinged frame systems. Hinged frame systems can be used in setting up exhibition or other display units, or as room dividers, or even in some constructions of furniture.

2. Description of the Prior Art

With conventional hinged frame systems, the structure is often flimsy and unstable. The present invention is concerned with providing a sturdy arrangement which is simple and economical to construct.

SUMMARY OF THE INVENTION

Accordingly, the invention provides a hinged frame system which includes at least two panels which are hingedly connected together, one of the two panels having a concave edge profile of a partially circular cross-section and the adjacent panel having a matching convex edge profile, and a clamp for clamping the two sections together with the convex edge profile of one panel located within the concave edge profile of the other panel, the clamp having a partially circular shape so as to partially encircle a portion of a circular section of an edge profile of one of the said panels for clamping it in relation to the other panel.

Generally, each panel will have one concave edge profile and one convex edge profile and then any number of panels can be hingedly connected together by use of a clamp between any two sections; although the end panel of any series need not necessarily have both types of profiles.

The convex edge profile of the respective panel (i.e the panel having such a convex edge profile) is preferably defined by a member which is a right circular cylinder and is attached in a concave edge profile of a partially circular cross-section in that panel. Thus, a standard panel may have two concave edge profiles and one of these may be converted to a convex edge profile by provision of a suitable cylindrical member.

The clamp may be a screw clamp having a partially circular shape at one end to engage the cylindrical member.

BRIEF DESCRIPTION OF THE DRAWINGS

An embodiment of the invention will now be described by way of example with reference to the accompanying diagrammatic drawings in which.

DETAILED DESCRIPTION OF PREFERRED EMBODIMENTS

Figure 1:
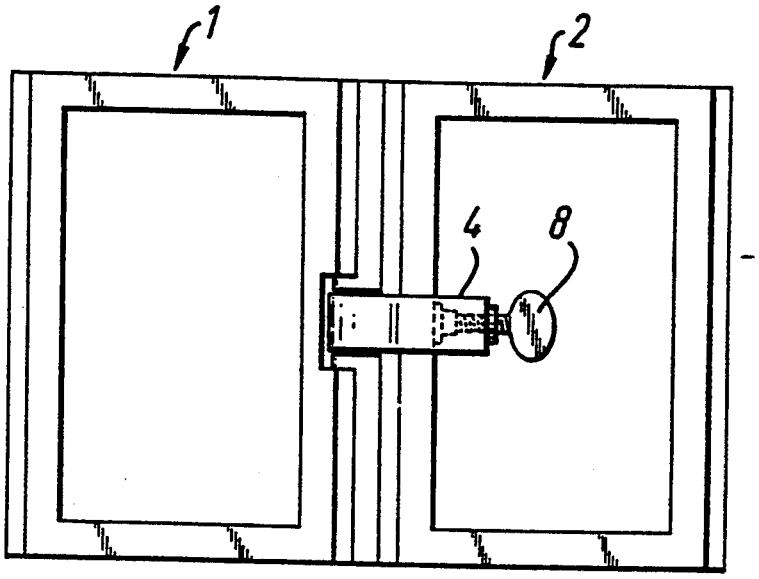
FIG. 1 is a side view of two panels hingedly connected together.

Referring to FIG. 1, two panels 1,2, are each formed from a covered timber frame structure and are hinged together via a cylindrical member 3 and a screw clamp 4.

Figure 2:
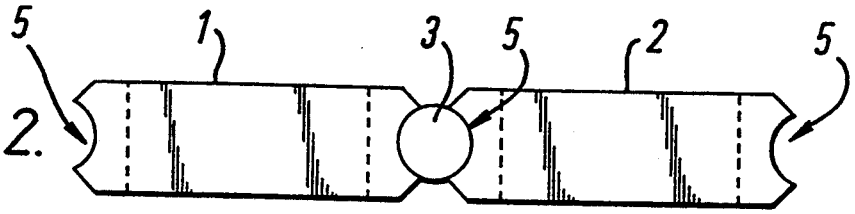
FIG. 2 is a top view of the two panels shown in FIG. 1.

Each panel has edge profiles which are bevelled and formed to have a partially circular cross-section at each side edge (see FIG. 2). These edge profiles are indicated by the arrow 5 in each case.

The cylindrical member 3 is adhesively attached to the panel 1 so that that panel 1 then presents a convex edge profile to the panel 2 thereby providing a hinge bearing for location of the two panels relative to one another.

Figure 3:
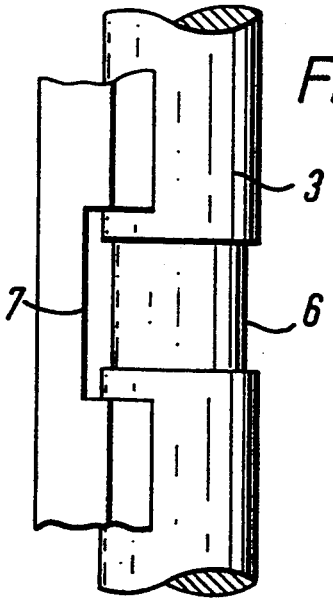
FIG. 3 is a fragmented detail view of a portion of FIG. 1.
Figure 4:
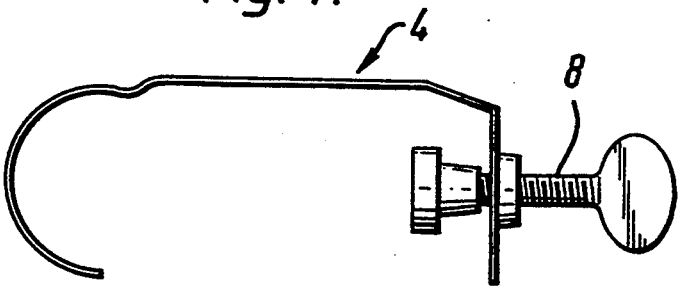
FIG. 4 is a view of a screw clamp.

Referring to the fragmentary detail in FIG. 3, the cylindrical member 3 has a central section 6 of slightly reduced diameter to accommodate the clamp 4. The profile edge of the panel 1 is also cut away at the position 7 to further make accommodation for the clamp 4.

With the clamp in position as shown in FIG. 1, the angular position of the two panels can readily be adjusted and then by tightening of the clamping screw 8 the two panels 1,2 can be firmly held together. With this arrangement, any number of panels can be linked together and firmly clamped so that they are rigidly held in position. The resultant structure is then particularly useful in the forming of an exhibition stand.

I claim:

1. A hinged frame system comprising:

at least first and second panels, the second panel having a concave edge profile formed to have a partially circular cross-section and the first panel having a convex edge profile formed to fit within the concave edge profile of the second panel; and a clamp for clamping the first and second panels together so that the convex edge profile of the first panel is located within the concave edge profile of the second panel, the clamp having a partially circular end portion located so as to partly encircle a partially circular section of the convex edge profile of the first panel for clamping the first panel to the second panel.

2. A hinged frame system according to claim 1, wherein the convex edge profile of the first panel is defined by a right circular cylinder and is fixedly mounted in a concave edge profile of a partially circular cross-section formed in the first panel.

3. The hinged frame system of claim 1, wherein the clamp further comprises a threaded tightening member in contact with the second panel for tightening the clamp on the first and second panels.

4. The hinged frame system of claim 1, wherein the clamp is removably mounted on the first and second panels.

5. The hinged frame system of claim 1, wherein a central section of the convex edge profile of the first panel has a recess formed therein for receiving the partially circular end portion of the clamp.

6. The hinged frame system of claim 1, wherein the convex edge profile of the first panel is formed by a right circular cylinder and the first panel has a first concave edge profile in which the right circular cylinder forming the convex edge profile of the first panel is fixedly mounted and a second concave edge profile for receiving a convex edge profile of a third panel.

7. The hinged frame system of claim 6, wherein a frame of the first panel located along the concave edge profile of the first panel has a cut-away portion formed therein for allowing the partially circular end portion of the clamp to be inserted therethrough so as to partially surround the convex edge of the first panel.

8. The hinged frame system of claim 6, wherein the clamp further comprises a tightening member located on the second panel, the tightening member being movable toward and away from the partially circular end portion of the clamp to tighten and loosen the clamp.

9. The hinged frame system of claim 1, wherein the convex edge profile of the first panel is formed by a right circular cylinder and the right circular cylinder has a recessed portion for receiving the partially circular end portion of the clamp.

10. The hinged frame assembly of claim 1, wherein the clamp provides the only connection between the first and second panels.

11. A hinged frame assembly comprising:

a first panel having a convex shaped edge and a concave shaped edge;

a second panel having first and second concave shaped edges, the convex shaped edge of the first panel being fitted in the first concave shaped edge of the second panel; and a clamp removably mounted on the first and second panels so as to partially surround the convex shaped edge of the first panel and the first concave shaped edge of the second panel to secure the first and second panels to each other.

12. The hinged frame assembly of claim 11, wherein the clamp comprises an arm that extends across a frame of the first panel and a frame of the second panel.

13. The hinged frame assembly of claim 11, wherein the clamp comprises a hook-shaped end portion extending around the convex shaped edge of the first panel.

14. The hinged frame assembly of claim 13, wherein the convex shaped edge of the first panel has a recessed portion for receiving the hook-shaped end portion of the clamp.

15. The hinged frame assembly of claim 13, wherein a frame of the first panel has a cut-away portion for allowing the hook-shaped end portion of the clamp to be inserted therethrough so as to partially surround the convex shaped edge of the first panel.

16. The hinged frame assembly of claim 11, wherein the clamp comprises a threaded tightening member being movable relative to the first and second panels for tightening and loosening the clamp.

17. The hinged frame assembly of claim 11, wherein the concave shaped edge of the first panel and the second concave shaped edge of the second panel are formed to receive convex shaped edges of a third panel and a fourth panel, respectively.

18. The hinged frame system of claim 11, wherein the clamp is removably mounted on the first and second panels.

19. The hinged frame system of claim 13, wherein the convex edge profile of the first panel is formed by a right circular cylinder and the right circular cylinder has a recessed portion for receiving the partially circular end portion of the clamp.

20. The hinged frame assembly of claim 11, wherein the clamp provides the only connection between the first and second panels.

* * * * *